US011104159B2

(12) United States Patent
Ogawa

(10) Patent No.: US 11,104,159 B2
(45) Date of Patent: Aug. 31, 2021

(54) SHEET CONVEYING DEVICE AND IMAGE FORMING SYSTEM INCORPORATING THE SHEET CONVEYING DEVICE

(71) Applicant: Masato Ogawa, Kanagawa (JP)

(72) Inventor: Masato Ogawa, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/658,226

(22) Filed: Oct. 21, 2019

(65) Prior Publication Data

US 2020/0122491 A1 Apr. 23, 2020

(30) Foreign Application Priority Data

Oct. 22, 2018 (JP) ..... JP2018-198560
Oct. 11, 2019 (JP) ..... JP2019-188128

(51) Int. Cl.

| | |
|---|---|
| ***B65H 3/12*** | (2006.01) |
| ***B41J 11/00*** | (2006.01) |
| ***B65H 3/66*** | (2006.01) |
| ***B65H 3/14*** | (2006.01) |
| ***B65H 3/54*** | (2006.01) |
| *B65H 3/48* | (2006.01) |
| *B65H 3/68* | (2006.01) |

(52) U.S. Cl.

CPC ..... *B41J 11/0045* (2013.01); *B65H 3/128* (2013.01); *B65H 3/14* (2013.01); *B65H 3/54* (2013.01); *B65H 3/66* (2013.01); *B65H 3/48* (2013.01); *B65H 3/68* (2013.01); *B65H 2404/61* (2013.01)

(58) Field of Classification Search

CPC ..... B41J 11/0045; B65H 3/66; B65H 3/14; B65H 2404/61; B65H 3/128; B65H 3/54; B65H 3/48; B65H 3/68

See application file for complete search history.

(56) References Cited

U.S. PATENT DOCUMENTS 5,876,030 A * 3/1999 Dobbertin ..... B65H 3/54 271/13
8,083,223 B2 * 12/2011 Ikeda ..... B65H 3/128 271/145

(Continued)

FOREIGN PATENT DOCUMENTS

JP 1-285562 11/1989
JP 2004-155509 6/2004

(Continued)

*Primary Examiner* — Yaovi M Ameh
(74) *Attorney, Agent, or Firm* — Harness, Dickey & Pierce, P.L.C.

(57) ABSTRACT

A sheet conveying device includes a sheet container, an air blower, and a guide. The sheet container is configured to store a plurality of sheets. The air blower is configured to blow air to the plurality of sheets to separate a single sheet from subsequent sheets of the plurality of sheets. The guide is configured to contact a surface of the single sheet separated from the subsequent sheets of the plurality of sheets over a given region downstream from any position of an upstream region in a sheet conveyance direction to guide the single sheet. The upstream region is from an upstream end to a center of the single sheet in the sheet conveyance direction.

14 Claims, 10 Drawing Sheets

(56) References Cited

U.S. PATENT DOCUMENTS

| | | | | |
|---|---|---|---|---|
| 2011/0057380 | A1 | 3/2011 | Maeyama et al. | |
| 2013/0221054 | A1 | 8/2013 | Ogawa et al. | |
| 2015/0166280 | A1* | 6/2015 | Hino ..... | B65H 3/128<br>271/11 |
| 2017/0266987 | A1 | 9/2017 | Asada et al. | |
| 2017/0266988 | A1 | 9/2017 | Asada et al. | |
| 2017/0266989 | A1 | 9/2017 | Ogawa et al. | |
| 2017/0334218 | A1 | 11/2017 | Ogawa et al. | |
| 2018/0016106 | A1 | 1/2018 | Asada et al. | |
| 2018/0264852 | A1 | 9/2018 | Ohtake et al. | |

FOREIGN PATENT DOCUMENTS

| | | |
|---|---|---|
| JP | 2013-043745 | 3/2013 |
| JP | 2015-134685 | 7/2015 |

* cited by examiner

SHEET CONVEYING DEVICE AND IMAGE FORMING SYSTEM INCORPORATING THE SHEET CONVEYING DEVICE

CROSS-REFERENCE TO RELATED APPLICATIONS

This patent application is based on and claims priority pursuant to 35 U.S.C. § 119(a) to Japanese Patent Application Nos. 2018-198560, filed on Oct. 22, 2018, and 2019-188128, filed on Oct. 11, 2019, in the Japan Patent Office, the entire disclosure of each of which is hereby incorporated by reference herein.

BACKGROUND

Technical Field

This disclosure relates to a sheet conveying device and an image forming system incorporating the sheet conveying device.

Related Art

Sheet conveying devices are provided with a technique in which, when printing a sheet such as a flat sheet, air is blown to a sheet bundle to separate one sheet, which is a conveyance target, from other sheets. Such a technique restrains lifting of a sheet that is likely to be caused at an upstream region (a trailing end) of the sheet in a sheet conveyance direction when separating the sheet from the other sheets of the sheet bundle. Consequently, such sheet conveying devices prevent paper jam due to sheet conveyance failure.

SUMMARY

At least one aspect of this disclosure provides a sheet conveying device including a sheet container, an air blower, and a guide. The sheet container is configured to store a plurality of sheets. The air blower is configured to blow air to the plurality of sheets to separate a single sheet from subsequent sheets of the plurality of sheets. The guide is configured to contact a surface of the single sheet separated from the subsequent sheets of the plurality of sheets over a given region downstream from any position of an upstream region in a sheet conveyance direction to guide the single sheet. The upstream region is from an upstream end to a center of the single sheet in the sheet conveyance direction.

Further, at least one aspect of this disclosure provides an image forming system including the above-described sheet conveying device and an image forming apparatus configured to form an image on a sheet of the plurality of sheets from the sheet conveying device.

Further, at least one aspect of this disclosure provides a sheet conveying device including a sheet container, an air blower, a guide, and a support. The sheet container is configured to store a plurality of sheets. The air blower is configured to blow air to the plurality of sheets to separate a single sheet from subsequent sheets of the plurality of sheets. The guide is configured to contact a surface of the single sheet separated from the subsequent sheets of the plurality of sheets to guide the single sheet. The support is configured to support both ends of the guide in a sheet conveying direction of the single sheet. Both ends of the guide are movable with respect to the support by reciprocating motion in a direction of thickness of the single sheet.

Further, at least one aspect of this disclosure provides an image forming system including the above-described sheet conveying device and an image forming apparatus configured to form an image on the single sheet of the plurality of sheets from the sheet conveying device.

Further, at least one aspect of this disclosure provides a sheet conveying device including a sheet container, an air blower, a guide, and a support. The sheet container is configured to store a plurality of sheets. The air blower is configured to blow air to the plurality of sheets to separate a single sheet from subsequent sheets of the plurality of sheets. The guide is configured to contact a surface of the single sheet separated from the subsequent sheets of the plurality of sheets to guide the single sheet. The guide has a virtual axis extending along a sheet conveyance direction. The support is configured to support both ends of the guide in the sheet conveying direction of the single sheet. Both ends of the guide are movable with respect to the support by rotational motion about a virtual shaft that extends along the sheet conveyance direction.

Further, at least one aspect of this disclosure provides an image forming system including the above-described sheet conveying device and an image forming apparatus configured to form an image on the single sheet of the plurality of sheets from the sheet conveying device.

BRIEF DESCRIPTION OF THE SEVERAL VIEWS OF THE DRAWINGS

An exemplary embodiment of this disclosure will be described in detail based on the following figured, wherein.

DETAILED DESCRIPTION

Figure 1:
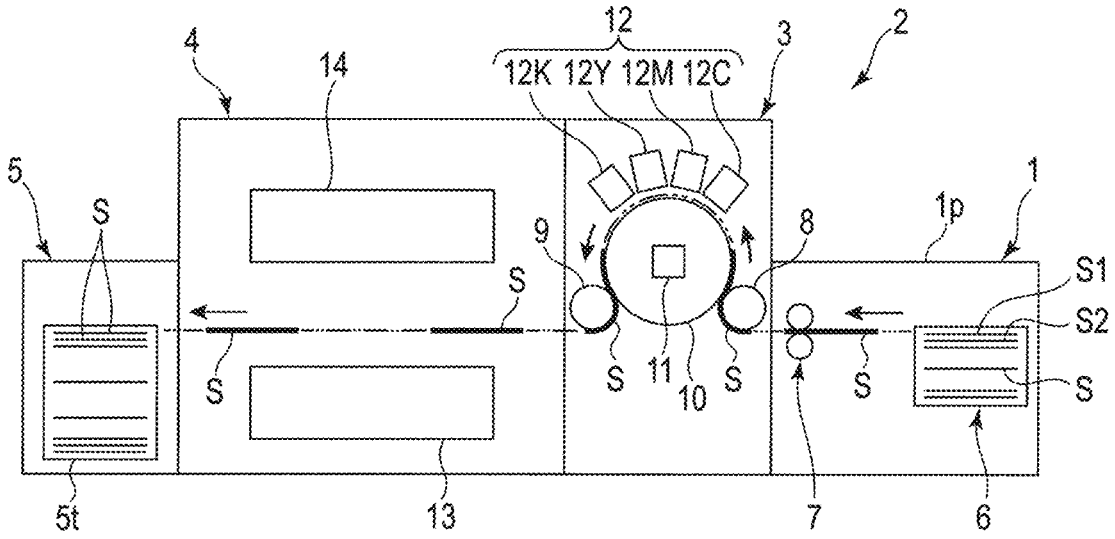
FIG. 1 is a diagram illustrating a configuration of an image forming system according to an embodiment of this disclosure.

It will be understood that if an element or layer is referred to as being "on", "against", "connected to" or "coupled to"

another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of a sheet conveying device and an image forming system according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any sheet conveying device, and is implemented in the most effective manner in any inkjet image forming system.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

Descriptions are given of an embodiment applicable to a sheet conveying device and an image forming system incorporating the sheet conveying device, with reference to the following figures.

It is to be noted that elements (for example, mechanical parts and components) having the same functions and shapes are denoted by the same reference numerals throughout the specification and redundant descriptions are omitted.

Configuration of Embodiment of this Disclosure

FIG. 1 is a diagram illustrating an entire configuration of an image forming system 2 including a sheet conveying device 1, according to an embodiment of this disclosure.

Further, size (dimension), material, shape, and relative positions used to describe each of the components and units are examples, and the scope of this disclosure is not limited thereto unless otherwise specified.

As illustrated in FIG. 1, the image forming system 2 includes the sheet conveying device 1, an image forming apparatus 3, a drying device 4, and a sheet ejecting device 5, which are mutually connected. According to this configuration, after each of a plurality of sheets S is fed from the sheet conveying device 1, an image is formed on the sheet S by the image forming apparatus 3. Then, each of the plurality of sheets S is dried by the drying device 4 to be stacked on a sheet ejection tray 5*t* of the sheet ejecting device 5.

The image forming system 2 may have a configuration of a known inkjet type image forming system.

Furthermore, the term "sheet" (including the plurality of sheets S) has no limitation in the material, thickness, shape, size, weight, and the like. For example, the sheet is not limited to indicate a paper material but also includes a recording medium such as thread, fiber, cloth, leather, metal, synthetic resin, plastic, glass, wood, ceramics, or the like. Further, the inkjet image forming system may be replaced with an electrophotographic image forming system in which an image is formed with toner.

The sheet conveying device 1 includes a sheet feeding unit 6 and a pair of registration rollers 7. The sheet feeding unit 6 and the pair of registration rollers 7 are housed in an interior of a housing 1*p* of the sheet conveying device 1. A door is openable and closable to be attached to the housing 1*p*. Closing the door maintains the interior of the housing 1*p* closely sealed from outside. On the other hand, by opening the door, the sheet feeding unit 6 that functions as a sheet feeder is pulled out from the housing 1*p* of the sheet conveying device 1. Thus, for example, the sheets S (e.g., the plurality of sheets S) are set and replenished with respect to the sheet feeding unit 6 and various types of maintenance are performed.

A sheet bundle (the plurality of sheets S) including the sheets S is disposed in the sheet feeding unit 6. The sheet feeding unit 6 blows air to the sheet bundle to separate a sheet S1 that functions as a conveyance target (for example, a single sheet of uppermost sheets of the sheet bundle) one by one from the other sheets S2 (in other words, subsequent sheets S2) of the sheet bundle, so that the sheet S1 is fed out from the sheet feeding unit 6. The pair of registration rollers 7 conveys the sheet S (e.g., the sheet S1 of the uppermost sheets of the sheet bundle) fed from the sheet feeding unit 6 to the image forming apparatus 3.

According to the above-described configuration, for example, each sheet S of the sheet bundle (the plurality of sheets) is sent out one by one from the sheet feeding unit 6. The leading end of each of the sheets S (the plurality of sheets) sent out from the sheet feeding unit 6 reaches the pair of registration rollers 7. Thereafter, the pair of registration rollers 7 is driven at a given timing. Thus, the sheet S is conveyed to the image forming apparatus 3.

It is to be noted that the details of the sheet feeding unit 6 are described below.

The image forming apparatus 3 includes a receiving cylinder 8, a transfer cylinder 9, a sheet carrying drum 10, an air suction unit 11, and an ink discharge unit 12. Sheet grippers are provided on a surface of the receiving cylinder 8, a surface of the transfer cylinder 9, and an outer circumferential surface of the sheet carrying drum 10. Each of the sheet grippers grips the leading end of the sheet S (in other words, a downstream end of the sheet S in a sheet conveyance direction). The air suction unit 11 is disposed within an inner loop of the sheet carrying drum 10. A plurality of dispersed suction holes is formed on the surface of the sheet carrying drum 10. The air suction unit 11 sucks air to generate a negative pressure, so that a suction airflow directed to the interior of the sheet carrying drum 10 is generated in each of the plurality of dispersed suction holes.

Further, the ink discharge unit 12 is disposed facing (opposing) the surface of the sheet carrying drum 10. The ink discharge unit 12 is configured to discharge inks of four colors of cyan (C), magenta (M), yellow (Y), and black (K). The ink discharge unit 12 includes individual ink discharge heads 12K, 12Y, 12M, and 12C for each of the four-color inks. Here, by controlling the ink discharge heads 12K, 12Y, 12M, and 12C, the respective inks of four colors are discharged toward the surface of the sheet carrying drum 10.

According to this configuration, after the sheet S has been fed out from the sheet conveying device 1 to the sheet carrying drum 10, while the sheet gripper of the receiving cylinder 8 grips the leading end of the sheet S, the sheet S is conveyed to the sheet carrying drum 10 as the receiving cylinder 8 rotates. After the sheet S has been conveyed to the sheet carrying drum 10, the sheet gripper of the sheet carrying drum 10 grips the leading end of the sheet S. At this time, the suction airflow described above is generated on the surface of the sheet carrying drum 10 (specifically, on the plurality of suction holes in the surface of the sheet carrying drum 10). According to this configuration, while being attracted by suction airflow on (the plurality of suction holes of) the surface of the sheet carrying drum 10, the sheet S is conveyed as the sheet carrying drum 10 rotates (in other words, as the surface of the sheet carrying drum 10 moves).

While the sheet S is conveyed along (the plurality of suction holes of) the surface of the sheet carrying drum 10, the ink discharge heads 12K, 12Y, 12M, and 12C are controlled. Respective inks are discharged from the ink discharge heads 12K, 12Y, 12M, and 12C toward the surface of the sheet S. According to this ink discharge, an image corresponding to previously set image information is formed on the surface of the sheet S. Thereafter, the leading end of the sheet S reaches the transfer cylinder 9. At this time, the transfer cylinder 9 is driven at a given timing. Thus, the sheet S is conveyed to the drying device 4 along with movement of the surface of the transfer cylinder 9 while the leading end of the sheet S is gripped by the transfer cylinder 9.

The drying device 4 includes a conveyance unit 13 and a drying unit 14. According to this configuration, the sheet S conveyed to the drying device 4 is dried by the drying unit 14 while being conveyed by the conveyance unit 13. In the drying process, for example, moisture of the image (ink) formed on the surface of the sheet S is evaporated. At this time, the image (ink) is fixed to the surface of the sheet S. Thus, the sheet S is conveyed to the sheet ejecting device 5 while curling (deformation due to curvature) is restrained.

The sheet ejecting device 5 includes a sheet ejection tray 5*t*. The sheet ejection tray 5*t* is configured to accumulate (stack) a plurality of sheets S. According to this configuration, the sheets S (the plurality of sheets S) conveyed from the drying device 4 are sequentially collected and stored in the sheet ejection tray 5*t*.

Variation of Image Forming System 2.

As one variation of the image forming system 2, for example, a pre-processing device may be interposed between the sheet conveying device 1 and the image forming apparatus 3. The pre-processing device is configured to perform pre-processing of image formation. As the pre-processing, for example, the pre-processing device may perform a pre-application process that applies processing liquid on the sheet S before the image formation. The processing liquid reacts with ink to reduce bleeding of the ink to the sheet S. However, the content of the pre-processing is not particularly limited to the process as described above.

As another variation of the image forming system 2, for example, a post-processing device may be interposed between the drying device 4 and the sheet ejecting device 5. The post-processing device is configured to perform post-processing of image formation. As the post-processing, for example, the post-processing device may perform a sheet reverse process that reverses the sheet S with the image (ink) formed on the front face side, before the image formation. By reversing the sheet S and then conveying the sheet S to the image forming apparatus 3 again, an image (ink) may be formed on the back face of the sheet S.

Sheet Feeding Unit 6 of Sheet Conveying Device 1.

Figure 2:
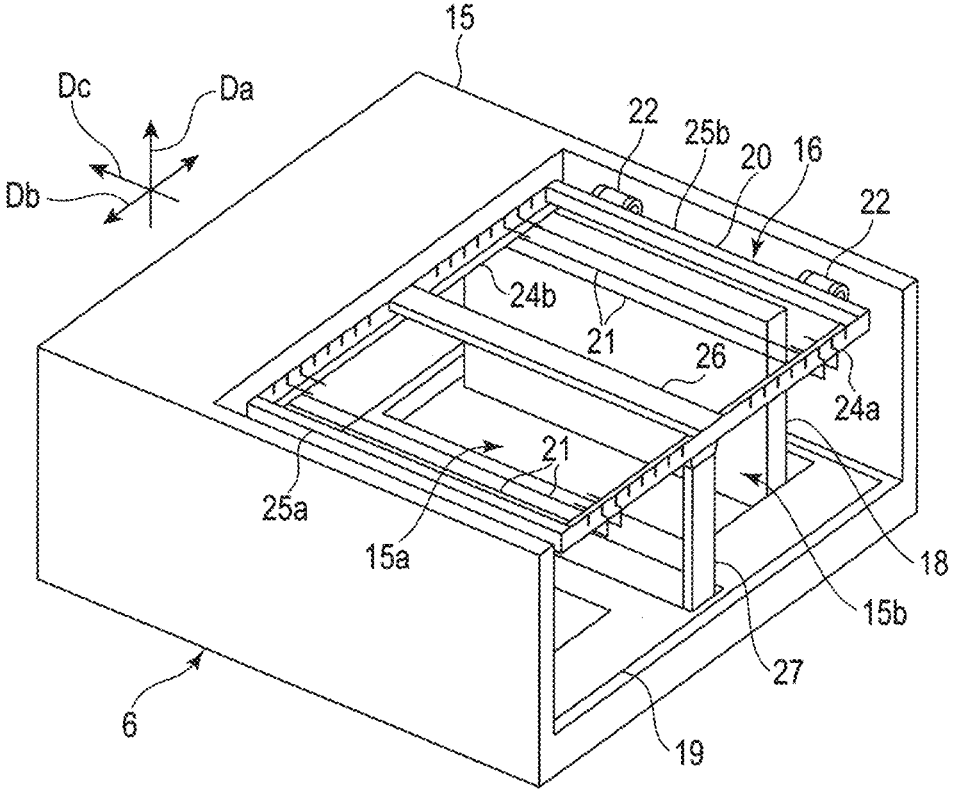
FIG. 2 is a perspective view illustrating a main configuration (of a sheet feeding unit) of a sheet conveying device provided to the image forming system of FIG. 1.

FIG. 2 is a perspective view illustrating the configuration of the sheet feeding unit 6 provided to the image forming system 2.

In FIG. 2, a vertical direction Da, a width direction Db, and a sheet conveyance direction Dc of the sheet feeding unit 6 are defined. These directions are in positional relation in which any two directions are perpendicular to each other. As illustrated in FIG. 2, the sheet feeding unit 6 includes a unit housing 15, a guide mechanism 16, and a feed mechanism 17 (see FIG. 6). The guide mechanism 16 and the feed mechanism 17 are disposed in the interior of the unit housing 15. It is to be noted that the details of the feed mechanism 17 are described below, referring to FIG. 6.

The unit housing 15 includes a sheet set opening 15*a* and a sheet containing portion 15*b*. In the example of FIG. 2, the unit housing 15 has a three-dimensional rectangular outline. The sheet set opening 15*a* is open at a top side of the unit housing 15 viewed from the vertical direction Da and an upstream side (a trailing end side) of the unit housing 15 viewed from the sheet conveyance direction Dc, penetrating the top side and the upstream side (the trailing end side) mutually in a rectangular shape. The sheet containing portion 15*b* that functions as a sheet container is provided in the interior of the unit housing 15 and is configured to receive the plurality of sheets S from the sheet set opening 15*a*. In other words, the plurality of sheets S are inserted into the unit housing 15 through the sheet set opening 15*a*. A pair of side walls 18 and a sheet tray 19 are provided in the sheet containing portion 15*b*. In this case, the plurality of sheets S inserted into the sheet containing portion 15*b* are collected and stored in the sheet tray 19 between the side walls of the pair of side walls 18.

The guide mechanism 16 is rotatably disposed with respect to the unit housing 15. When the sheet S is conveyed, the guide mechanism 16 restrains the rise of the sheet S1 (see FIG. 1) that is a conveyance target of the plurality of sheets S contained in the sheet containing portion 15*b* and guides the sheet S1 in the sheet conveyance direction Dc. Here, the sheet S that functions as a conveyance target corresponds to one sheet S1 of the uppermost sheets of the sheet bundle, in other words, of the plurality of sheets S, contained in the sheet containing portion 15*b*. It is to be noted that the above-described sheet tray 19 is configured to move upward and downward in the vertical direction Da. By so doing, among the plurality of sheets S contained in the sheet containing portion 15*b*, the sheet S1 of the uppermost sheets is constantly positioned to a previously set position (for example, a sheet conveyance start position).

The guide mechanism 16 includes a frame 20 and guides 21. The frame 20 has a hollowed rectangular shape and is coupled to the unit housing 15 (the sheet feeding unit 6) via hinges 22 (to be more specific, two hinges 22). In the example illustrated in FIG. 2, the frame 20 is disposed so as to cover the upper side of the sheet set opening 15*a* (the sheet containing portion 15*b*). The two hinges 22 are interposed between one side of the frame 20 (a second connecting portion 25*b* described below) and the unit housing 15. According to this configuration, the frame 20 is configured to be openable and closable to the sheet set opening 15*a* (the sheet containing portion 15*b*) via the hinges 22.

Figure 3:
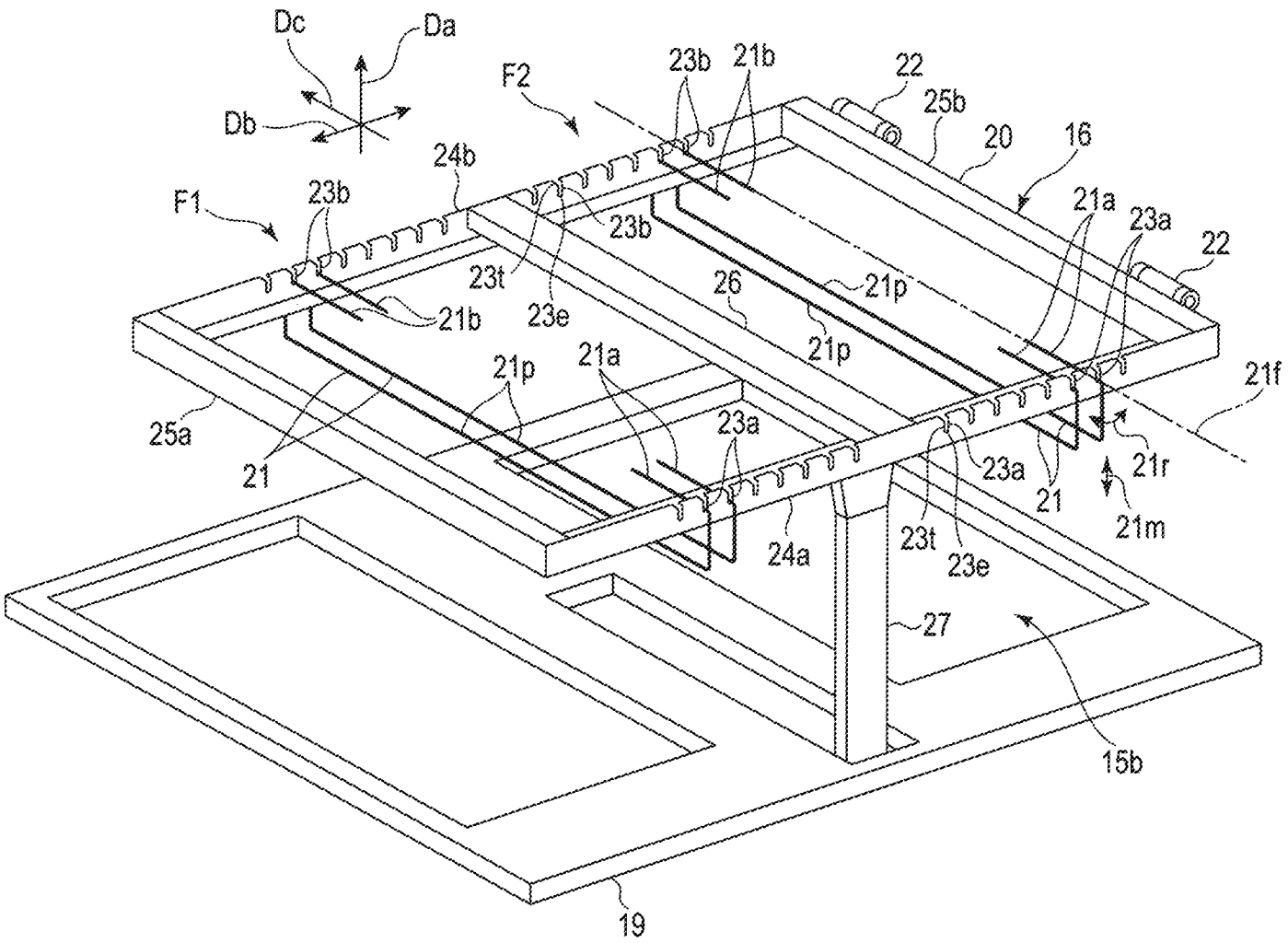
FIG. 3 is a perspective view illustrating a configuration of guides in the sheet feeding unit of FIG. 2.

FIG. 3 is a perspective enlarged view illustrating the main part of the guide mechanism 16 (for example, the frame 20, the guides 21, first receiving portions 23*a*, and second receiving portions 23*b*).

As illustrated in FIG. 3, the frame 20 includes two supports (i.e., a first support 24*a* and a second support 24*b*), two connecting portions (i.e., a first connecting portion 25*a* and the second connecting portion 25*b*), and a reinforcement member 26.

The first support 24*a* is disposed on the upstream side in the sheet conveyance direction Dc. The second support 24*b* is disposed on the downstream side in the sheet conveyance direction Dc. Specifically, the first support 24*a* is disposed upstream from the second support 24*b* in the sheet conveyance direction Dc (in other words, the second support 24*b* is disposed downstream from the first support 24*a* in the sheet conveyance direction Dc). The first support 24*a* and the second support 24*b* are disposed extending in the sheet conveyance direction Dc and facing each other in parallel in the sheet conveyance direction Dc. The first support 24*a* and the second support 24*b* have both ends (in other words, one end and an opposed end) and have shapes identical to each other with the same dimension (lengths).

The two connecting portions, which are the first connecting portion 25*a* and the second connecting portion 25*b*, are disposed between the first support 24*a* and the second support 24*b*. In this case, the first connecting portion 25*a* is mutually connected to one end of the first support 24*a* and one end of the second support 24*b*. The second connecting portion 25*b* is mutually connected to the opposed end of the first support 24*a* and the opposed end of the second support 24*b*. The first connecting portion 25*a* and the second connecting portion 25*b* are disposed extending in the sheet conveyance direction Dc and facing each other in parallel in the width direction Db. The first connecting portion 25*a* and the second connecting portion 25*b* are mutually set to have the same dimensions (lengths) and the same shapes.

The reinforcement member 26 is disposed between the first connecting portion 25*a* and the second connecting portion 25*b*. In other words, the reinforcement member 26 is disposed at a position where the first support 24*a* and the second support 24*b* are divided into two equal parts in the width direction Db and extend along the sheet conveyance direction Dc. An end fence 27 is disposed on the reinforcement member 26 (the frame 20). One end of the end fence 27 is supported by the reinforcement member 26 and the opposed end of the end fence 27 extends downward along the vertical direction Da. The end fence 27 is configured to reciprocate along the reinforcement member 26. In this case, the end fence 27 is moved in a state in which the plurality of sheets S is stored in the sheet containing portion 15*b*. Accordingly, the trailing end of the sheet S (the upstream side end in the sheet conveyance direction Dc) is aligned by the end fence 27.

Further, the frame 20 includes a plurality of receiving portions (i.e., the first receiving portions 23*a* and the second receiving portions 23*b*). The first receiving portions 23*a* and the second receiving portions 23*b* that functions as a plurality of receiving portions support the guides 21 to be detachably attachable to the frame 20. The first receiving portions 23*a* are a plurality of receiving portions disposed along the first support 24*a*. The second receiving portions 23*b* are a plurality of receiving portions disposed along the second support 24*b*. For these reasons, the first receiving portions 23*a* and the second receiving portions 23*b* are disposed along the width direction Db that intersects the sheet conveyance direction Dc. In FIG. 3, as an example, on both sides (i.e., a first side F1 and a second side F2) of the reinforcement member 26, the first receiving portions 23*a* and the second receiving portions 23*b* are set to the equal number and arranged at equal intervals to each other. In other words, the number of the first receiving portions 23*a* is identical to the number of the second receiving portions 23*b*, the first receiving portions 23*a* are disposed at equal intervals, and the second receiving portions 23*b* are disposed at equal intervals.

The first receiving portions 23*a* and the second receiving portions 23*b* are aligned along the sheet conveyance direction Dc and disposed facing each other. In this case, for example, the guides 21 (for example, first hooks 21*a* and second hooks 21*b*) are placed on the two first receiving portions 23*a* and the two second receiving portions 23*b* aligned each other along the sheet conveyance direction Dc. Accordingly, the guides 21 are disposed along the sheet conveyance direction Dc.

The first receiving portions 23*a* and the second receiving portions 23*b* share the same shape and size. Each of the first receiving portions 23*a* has a recessed shape vertically recessed from the upper end to the lower end of a part of the first support 24*a*, as viewed in the vertical direction Da. Similarly, each of the second receiving portions 23*b* has a recessed shape vertically recessed from the upper end to the lower end of a part of the second support 24*b*, as viewed in the vertical direction Da. Each of the receiving portions, i.e., the first receiving portions 23*a* and the second receiving portions 23*b*, has an upper end 23*t* that is open and a lower end 23*e* that is closed, as viewed in the vertical direction Da.

According to this configuration, the guides 21 (including the first hooks 21*a* and the second hooks 21*b*) are inserted from the upper end 23*t* that is open, to the first receiving portions 23*a* and the second receiving portions 23*b*. Accordingly, the guides 21 (the first hooks 21*a* and the second hooks 21*b*) are placed on the lower end 23*e* that is closed while being in contact with the lower end 23*e*. As a result, the guides 21 are supported by the frame 20 via the first receiving portions 23*a* and the second receiving portions 23*b*.

Further, the first receiving portions 23*a* and the second receiving portions 23*b*, each having a recessed shape, are bent at the upper end 23*t* side (the opening side). In FIG. 3, as an example, the upper end 23*t* side (the opening side) of the first receiving portions 23*a* and the second receiving portions 23*b* are bent in a direction separating from the hinges 22 (the second connecting portion 25*b*). In other words, the upper end 23*t* side (the opening side) of the first receiving portions 23*a* and the second receiving portions 23*b* are bent in a direction approaching the first connecting portion 25*a*.

According to this configuration, the frame 20 is rotated via the hinges 22. For example, the frame 20 is rotated so as to open the sheet set opening 15*a* (the sheet containing portion 15*b*). While the frame 20 is being rotated, the guides 21 (the first hooks 21*a* and the second hooks 21*b*) do not climb over the upper end 23*t* (the opening side) that is bent. That is, the guides 21 (the first hooks 21*a* and the second hooks 21*b*) are supported by the first receiving portions 23*a* and the second receiving portions 23*b*. Accordingly, the guides 21 (the first hooks 21*a* and the second hooks 21*b*) do not come out of (drop from) the first receiving portions 23*a* and the second receiving portions 23*b*. As a result, the guides 21 are constantly supported by the frame 20 via the first receiving portions 23*a* and the second receiving portions 23*b*.

Each of the guides 21 has a sheet contact portion 21*p* and the hooks (i.e., the first hook 21*a* and the second hook 21*b*). In the example illustrated in FIG. 3, the sheet contact portion 21*p* has a long straight line shape extending straight. The sheet contact portion 21*p* is extended having a columnar shape with a circular cross section. The diameter of the sheet contact portion 21*p* is set to be equal (constant) over the entire length of the sheet contact portion 21*p*. Further, the hooks (i.e., the first hook 21*a* and the second hook 21*b*) are provided at both ends. In other words, the first hook 21*a* is provided at one end of the sheet contact portion 21*p* and the second hook 21*b* is provided at the opposed end of the sheet contact portion 21*p*.

Here, the length of each of the guides 21 (that is, the sheet contact portion 21*p*) is set in correspondence with the length (along the sheet conveyance direction Dc) of the sheet S stored in the sheet containing portion 15*b*. Specifically, the entire length of the sheet contact portion 21*p* is set to contact throughout the entire length of the surface of the sheet S1, which functions as a conveyance target, from an upstream region (i.e., the trailing end of the sheet S1) to a downstream region (i.e., the leading end of the sheet S1) in the sheet conveyance direction Dc. To be more specific, the entire length of the sheet contact portion 21*p* is set to contact throughout the entire length of the surface of the sheet S1 (a conveyance target), over an area from the upstream region (i.e., the trailing end of the sheet S1) to the downstream region (i.e., the leading end of the sheet S1) via a center of the sheet S1 in the sheet conveyance direction Dc. Here, the term "upstream region" is a concept including a region between the trailing end of the sheet S1 in the sheet conveyance direction Dc and the center of the sheet S1, and the term "downstream region" is a concept including a region between the leading end of the sheet S1 and the center of the sheet S1 in the sheet conveyance direction Dc. It is to be noted that, instead of the configuration according to the present embodiment, each of the guides 21 (that is, the sheet contact portion 21*p*) may be set to contact the sheet S1 that is one of the uppermost sheets, functioning as a conveyance target, of the plurality of sheets S stored in the sheet containing portion 15*b*, from the upstream region to the center of the sheet S1 in the sheet conveyance direction Dc.

Each of the first hooks 21*a* is integrated with the one end of the sheet contact portion 21*p*. Further, each of the first hooks 21*a* is bent toward the opposed end (i.e., the corresponding opposed one of the second hooks 21*b*) of the sheet contact portion 21*p*. On the other hand, each of the second hooks 21*b* is integrated with the opposed end of the sheet contact portion 21*p*. Each of the second hooks 21*b* is bent toward the opposed end (i.e., the corresponding opposed one of the first hooks 21*a*) of the sheet contact portion 21*p*. The first hooks 21*a* and the second hooks 21*b* are set to have the same shape and diameter.

According to this configuration, any of the first hooks 21*a* is inserted into (placed onto) a corresponding one of the first receiving portions 23*a* of the first support 24*a* and, at the same time, any of the second hooks 21*b* is inserted into (placed onto) a corresponding one of the second receiving portions 23*b* of the second support 24*b*. Accordingly, the sheet contact portion 21*p* is supported by the first support 24*a* and the second support 24*b* via the first hook 21*a* and the second hook 21*b*, respectively. As a result, the guide 21 is supported by the frame 20. In the above-described state, the guide 21 maintains the attitude in which the guide 21 hangs down with the own weight along the vertical direction Da (also referred to as the direction of gravitational force). In other words, the guide 21 maintains the attitude in which the sheet contact portion 21*p* is positioned immediately below the first hook 21*a* and the second hook 21*b*, viewed in the direction of gravitational force. At this time, the guide 21 (specifically, the sheet contact portion 21*p*) is disposed parallel to the surface of the sheet S1 that is one of the uppermost sheets (that is, the sheet S1 as a conveyance target) of the plurality of sheets S stored in the sheet containing portion 15*b* and is disposed parallel to the sheet conveyance direction Dc.

As an example illustrated in FIG. 3, two guides 21 each are supported at symmetrical positions of both sides (i.e., the first side F1 and the second side F2) of the reinforcement member 26, viewed in the width direction Db. The guides 21 are maintained in respective attitudes in which the sheet contact portion 21*p* is positioned immediately below the first hook 21*a* and the second hook 21*b*, by the own weights of the guides 21. At this time, the respective guides 21 are changeable in position (in other words, positional change) by rotational motion 21*r* and reciprocating motion 21*m* to reduce frictional resistance (load resistance) between the guide 21 (the sheet contact portion 21*p*) and the sheet S. It is to be noted that such positional change (i.e., movement of each of the guides 21 by rotational motion 21*r* and reciprocating motion 21*m*) may generate according to a contact state between the guide 21 and the sheet S1 as a conveyance target separated from the subsequent sheets S2, for example, when the sheet S is fed from the sheet feeding unit 6 (at sheet feeding).

Here, as one assumption, the rotational motion 21*r* of the guide 21 is performed by rotating about a virtual axis 21*f* extending along the sheet conveyance direction Dc (for example, an axis formed by extending both the first hook 21*a* and the second hook 21*b* in the sheet conveyance direction Dc). The reciprocating motion 21*m* of the guide 21 is assumed, for example, to be a reciprocating motion moving, at sheet feeding, along a direction in which the sheet S1 that functions as a conveyance target separates from the subsequent sheets S2 (in other words, along a thickness direction intersecting (or perpendicular to) the surface of the sheet S1). In this case, the reciprocating motion 21*m* of the guides 21 corresponds to a reciprocating motion in which the sheet contact portion 21*p* lifts or lowers, viewed in the vertical direction Da, when the first hooks 21*a* and the second hooks 21*b* rotate about the virtual axis 21*f* (the line of axis) of rotation of the guides 21.

To be more specific, the positional change of each of the guides 21 (movement of each of the guides 21 by the rotational motion 21*r* or the reciprocating motion 21*m*) described above is likely to generate according to types (for example, the thickness, weight, and so on) of the sheet S1 that functions as a conveyance target. For example, if the sheet S1 functioning as a conveyance target is a lightweight, thin sheet, the position of the guide 21 that is brought to contact the sheet S1 does not change. In other words, since the pressing force from the lightweight, thin sheet S1 applies small pressing force to the guide 21, the guide 21 is maintained in the initial hanging posture without changing the position. By contrast, if the sheet S1 functioning as a conveyance target is a heavyweight, thick sheet, the position of the guide 21 that is brought to contact the sheet S1 changes. In other words, since the pressing force from the heavyweight, thick sheet S1 applies large pressing force to the guide 21, the guide 21 performs the rotational motion 21*r* about the virtual axis 21*f* or the reciprocating motion 21*m* along the thickness direction.

In a case in which the plurality of sheets S is inserted into the sheet containing portion 15*b* of the sheet feeding unit 6, for example, the frame 20 is rotated via the hinges 22 while supporting the above-described four guides 21. In this case, the sheet feeding unit 6 is pulled out from the housing 1*p* of the sheet conveying device 1.

Figure 4:
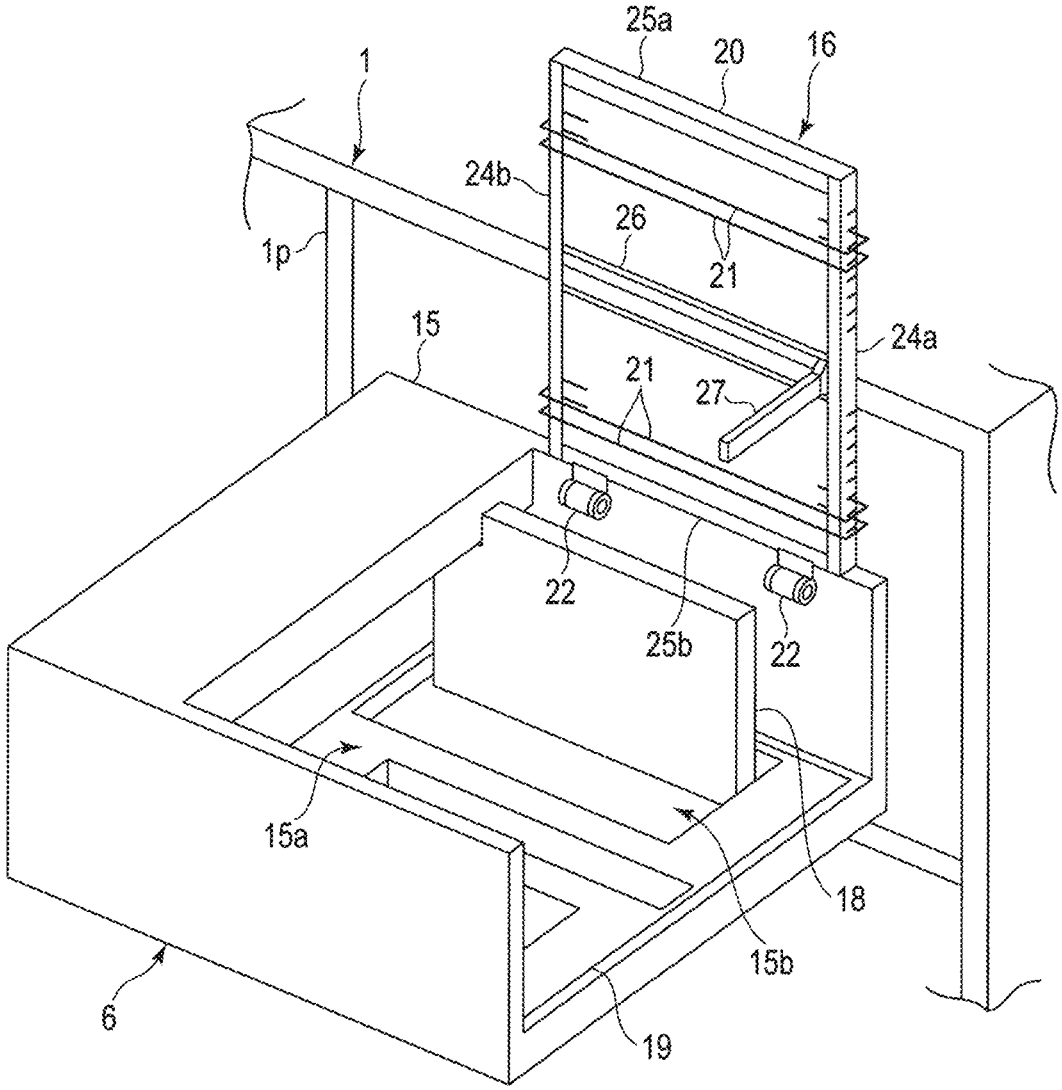
FIG. 4 is a perspective view illustrating the sheet feeding unit with the guides are exposed in an open state when the sheet feeding unit is pulled out from the sheet conveying device.

FIG. 4 is a perspective view illustrating the sheet feeding unit 6 with the guides 21 in an open state in which the sheet feeding unit 6 is pulled out from the housing 1*p* of the sheet conveying device 1.

As described above, the sheet feeding unit 6 is provided, together with the frame 20 supporting the guides 21, in the housing 1*p* of the sheet conveying device 1. In this case, as the door of the housing 1*p* opens, the sheet feeding unit 6 is pulled out (removed), together with the frame 20, to the outside of the housing 1*p*.

Here, as illustrated in FIG. 4, in the state in which the sheet feeding unit 6 remains outside the housing 1*p*, the frame 20 is rotated together with the guide 21 to open the sheet set opening 15*a* (the sheet containing portion 15*b*). Then, the plurality of sheets S is inserted into the sheet containing portion 15*b* through the sheet set opening 15*a*. Thus, the plurality of sheets S that has been inserted in the sheet containing portion 15*b* is accumulated and stored between the pair of side walls 18 on the sheet tray 19.

Then, the frame 20 is rotated to close the sheet set opening 15*a* (the sheet containing portion 15*b*). Thereafter, the sheet feeding unit 6 is stored, together with the frame 20 supporting the guides 21, in the housing 1*p* of the sheet conveying device 1. Then, the door of the housing 1*p* is closed. Accordingly, the sheet feeding unit 6 is stored in the housing 1*p* again.

According to this configuration with the end fence 27 being mounted on the frame 20 (the reinforcement member 26), both a process in which the end fence 27 is retreated from the sheet set opening 15*a* (the sheet containing portion 15*b*) and another process in which the sheet set opening 15*a* (the sheet containing portion 15*b*) is opened are performed simultaneously with a single rotation of the frame 20. Thus, the setting efficiency of the sheet S to the sheet containing portion 15*b* is enhanced.

Figure 5:
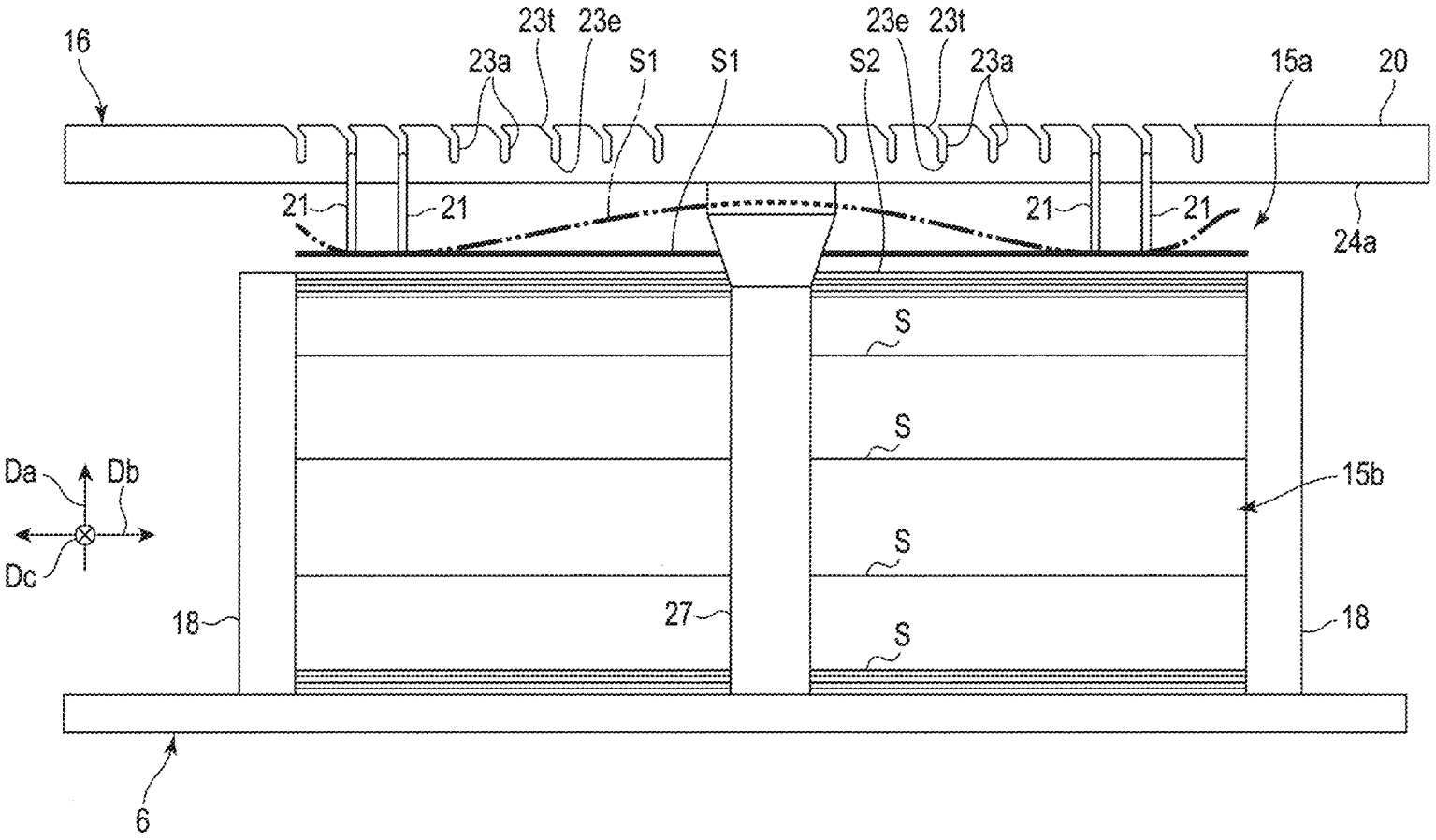
FIG. 5 is a side view illustrating the guides in a closed state after a sheet is set in the sheet feeding unit of FIG. 4.

FIG. 5 is a side view illustrating the sheet feeding unit 6 stored in the housing 1*p*, viewed from the end fence 27 side.

As illustrated in FIG. 5, the plurality of sheets S that has been inserted in the sheet containing portion 15*b* of the sheet feeding unit 6 is accumulated and stored between the pair of side walls 18 on the sheet tray 19. In this state, the feed mechanism 17 is operated. Details of the feed mechanism 17 are described below. Accordingly, the sheet S1 that functions as a conveyance target is fed out from the sheet feeding unit 6.

Figure 6:
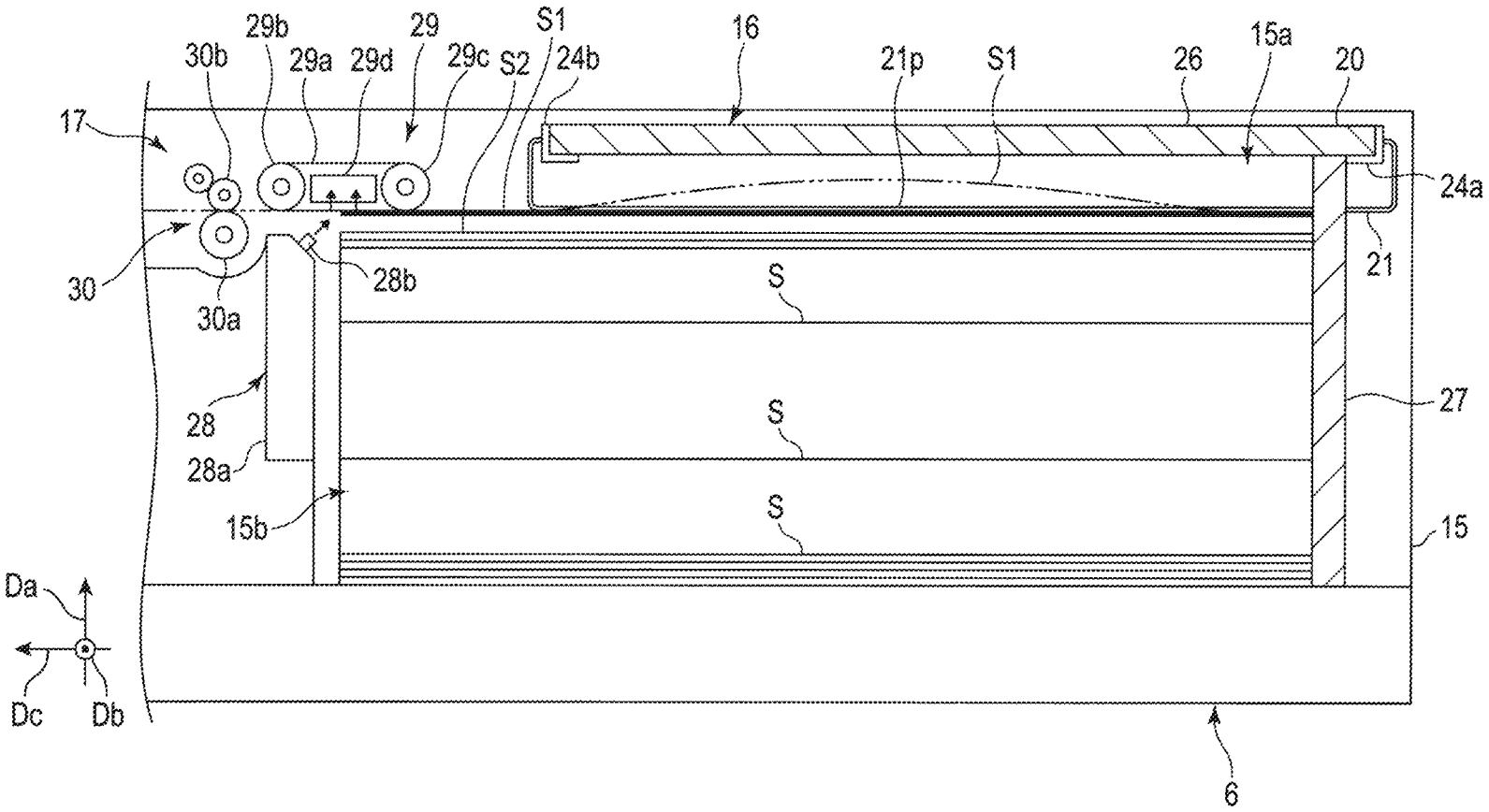
FIG. 6 is a side view illustrating a feed mechanism provided to the sheet feeding unit.

FIG. 6 is a side view illustrating the feed mechanism 17 provided in the sheet feeding unit 6.

As illustrated in FIG. 6, the feed mechanism 17 is disposed adjacent to the sheet containing portion 15*b* and on the downstream side (the leading end side) of the sheet S in the sheet conveyance direction Dc. In this case, the feed mechanism 17 includes an air blowing device 28 (also referred to as an air blower), an air suction device 29, and a group of sheet feed rollers 30. It is to be noted that the configuration of the feed mechanism 17 illustrated in FIG. 6 is an example configuration, and another configuration may be applied to the feed mechanism 17.

The air blowing device 28 (that functions as an air blower) includes a housing 28*a* and a nozzle 28*b*. The housing 28*a* is configured to supply compressed air to the nozzle 28*b*. The nozzle 28*b* is configured to blow air supplied by the housing 28*a*. In the example of FIG. 6, the nozzle 28*b* is configured to blow air toward the sheet S1 at the sheet conveyance start position (i.e., one sheet S1 of the uppermost sheets of the plurality of sheets S stored in the sheet containing portion 15*b*) and the sheet(s) S2 near the sheet S1 and the plurality of sheets S.

The air suction device 29 includes an attraction belt 29*a* in a form of an endless loop, a pair of rollers 29*b* and 29*c* (for example, a drive roller 29*b* and a driven roller 29*c*), and an air suction unit 29*d*. The attraction belt 29*a* is wound around the pair of rollers, that is, the drive roller 29*b* and the driven roller 29*c*. The attraction belt 29*a* has a plurality of suction holes are scattered over the entire surface. The plurality of suction holes penetrates through the thickness of the attraction belt 29*a*. In this case, for example, as the drive roller 29*b* rotates, the attraction belt 29*a* is moved in a sheet feed direction.

The air suction unit 29*d* is disposed inside the loop of the attraction belt 29*a* and communicates with the pair of rollers, that is, the drive roller 29*b* and the driven roller 29*c*. The air suction unit 29*d* is configured to generate the negative pressure to the lower side of the attraction belt 29*a* (in other words, the region opposed to the one sheet S1 of the uppermost sheets of the plurality of sheets S contained in the sheet containing portion 15*b*), viewed from the vertical direction Da. In this case, generation of the negative pressure to the lower side of the attraction belt 29*a* generates suction airflow from each suction hole toward the attraction belt 29*a*.

The group of sheet feed rollers 30 includes a pair of conveyance rollers (for example, conveyance rollers 30*a* and 30*b*). The pair of conveyance rollers, i.e., the conveyance rollers 30*a* and 30*b* in contact with each other rotate opposite to each other. By so doing, the sheet S that has reached the pair of conveyance rollers, that is, the conveyance rollers 30*a* and 30*b*, is conveyed toward the pair of registration rollers 7 (see FIG. 1).

According to this configuration, for example, while the attraction belt 29*a* is moving, the negative pressure is generated to the lower side of the attraction belt 29*a*. During the above-described action, air is blown from the nozzle 28*b* to the sheet S1 at the sheet conveyance start position and the subsequent sheets S2 and the plurality of sheets S near the sheet S1. By so doing, the sheet S1 of the uppermost sheets of the plurality of sheets S contained in the sheet containing portion 15*b* (in other words, the sheet S1 functioning as a conveyance target) is separated from the other sheet S2 to float. Thus, the leading end side of the sheet S1 functioning as a conveyance target is attracted to the attraction belt 29*a*.

In this state, the attraction belt 29*a* is moved. With the movement of the attraction belt 29*a*, the sheet S1 functioning as a conveyance target is fed out toward the group of sheet feed rollers 30. Consequently, the leading end side of the sheet S1 functioning as a conveyance target reaches the pair of conveyance rollers (for example, the conveyance rollers 30*a* and 30*b*). At this time, the conveyance rollers 30*a* and 30*b* are rotated. As a result, the sheet S1 functioning as a conveyance target is conveyed to the image forming apparatus 3 via the pair of registration rollers 7 described above.

Exemplary Effective Operations of the Present Embodiment

According to the present embodiment, the sheet feeding unit 6 includes the guides 21 to contact the surface of the sheet S1 functioning as a conveyance target over the area from the upstream region to the downstream region in the sheet conveyance direction Dc to guide the sheet S1. In this case, the sheet S1 functioning as a conveyance target is guided by the guides 21 while contacting over the given area from the upstream region to the downstream region of the sheet S1, viewed in the sheet conveyance direction Dc. With this configuration, the sheet S1 functioning as a conveyance target is restrained from floating as indicated by broken lines in FIGS. 5 and 6. That is, this configuration restrains floating of the sheet S1 functioning as a conveyance target in the upstream region (the trailing end) of the sheet S1 and in the downstream region that is downstream from the upstream region, simultaneously. As a result, jam or paper jam caused by conveyance failure of the sheet S1 is prevented before occurring.

According to the present embodiment, it is preferable that the guides 21 contact the surface of the sheet S1 over an area from at least the upstream region of the sheet S1 in the sheet conveyance direction Dc to the center of the sheet S1 in the sheet conveyance direction Dc, so as to guide the sheet S1. With this configuration, the center of the sheet S1 that is easy to float by air blown from the air blowing device 28 is pressed down by the guides 21. As a result, the floating of the sheet S1 in the region from the trailing end of the sheet S1 including the center of the sheet S1 is restrained effectively.

According to the present embodiment, it is more preferable that the above-described given region is the downstream region (the leading end) of the sheet S1 in the sheet conveyance direction Dc. With this configuration, the guides 21 press down the substantially entire area in the sheet conveyance direction Dc of the sheet S1 that is about to float due to air blown by the air blowing device 28. As a result, floating of the sheet S1 is prevented more effectively.

According to the present embodiment, it is more preferable that the guides 21 are provided further from the trailing end (the end of the upstream side) of the sheet S1. Accordingly, curling of the trailing end of the sheet S1 is prevented.

According to the present embodiment, it is preferable that the guides 21 are parallel to the surface of the sheet S1 contained in the sheet containing portion 15*b* and parallel to the sheet conveyance direction Dc of the sheet S1. Accordingly, while maintaining the posture of the sheet S1 floating by air blown by the air blowing device 28, the sheet S1 is conveyed toward a downstream sheet conveyance passage (that is, the group of sheet feed rollers 30) without causing skew or other failure.

According to the present embodiment, the guides 21 are provided with functions capable of changing the position, such as the rotational motion 21*r* and the reciprocating motion 21*m*. In this case, in the rotational motion 21*r* of each of the guides 21, the sheet contact portion 21*p* rotates about the virtual axis 21*f* of the guides 21. Further, in the reciprocating motion 21*m* of each of the guides 21, the sheet contact portion 21*p* moves in the vertical direction Da. Consequently, the sheet S1 functioning as a conveyance target is separated from the subsequent sheets S2 by an optimal distance, so that the sheet S1 is held at a position to be conveyed easily and is positioned parallel in the sheet conveyance direction Dc. As a result, the sheet S1 separated by air is significantly enhanced in the conveyance accuracy and conveyance stability.

According to the present embodiment, the end fence 27 is mounted on the frame 20 (the reinforcement member 26). According to this configuration, both a process in which the end fence 27 is retreated from the sheet set opening 15*a* (the sheet containing portion 15*b*) and another process in which the sheet set opening 15*a* (the sheet containing portion 15*b*) is opened are performed simultaneously with a single rotation of the frame 20. As a result, the setting efficiency of the sheet S with respect to the sheet containing portion 15*b* is dramatically enhanced.

According to this embodiment, the upper end 23*t* side (the opening side) of the first receiving portions 23*a* and the second receiving portions 23*b* that support the guides 21 (the first hooks 21*a* and the second hooks 21*b*) is bent. In this case, the upper end 23*t* side (the opening side) is bent in a direction away from the hinges 22 (the second connecting portion 25*b*). By so doing, even when the frame 20 is rotated in order to open the sheet set opening 15*a* (the sheet containing portion 15*b*), the guides 21 (the first hooks 21*a* and the second hooks 21*b*) do not come off from the first receiving portions 23*a* and the second receiving portions 23*b*. As a result, the guides 21 are constantly supported by the frame 20 via the first receiving portions 23*a* and the second receiving portions 23*b*.

Figure 7:
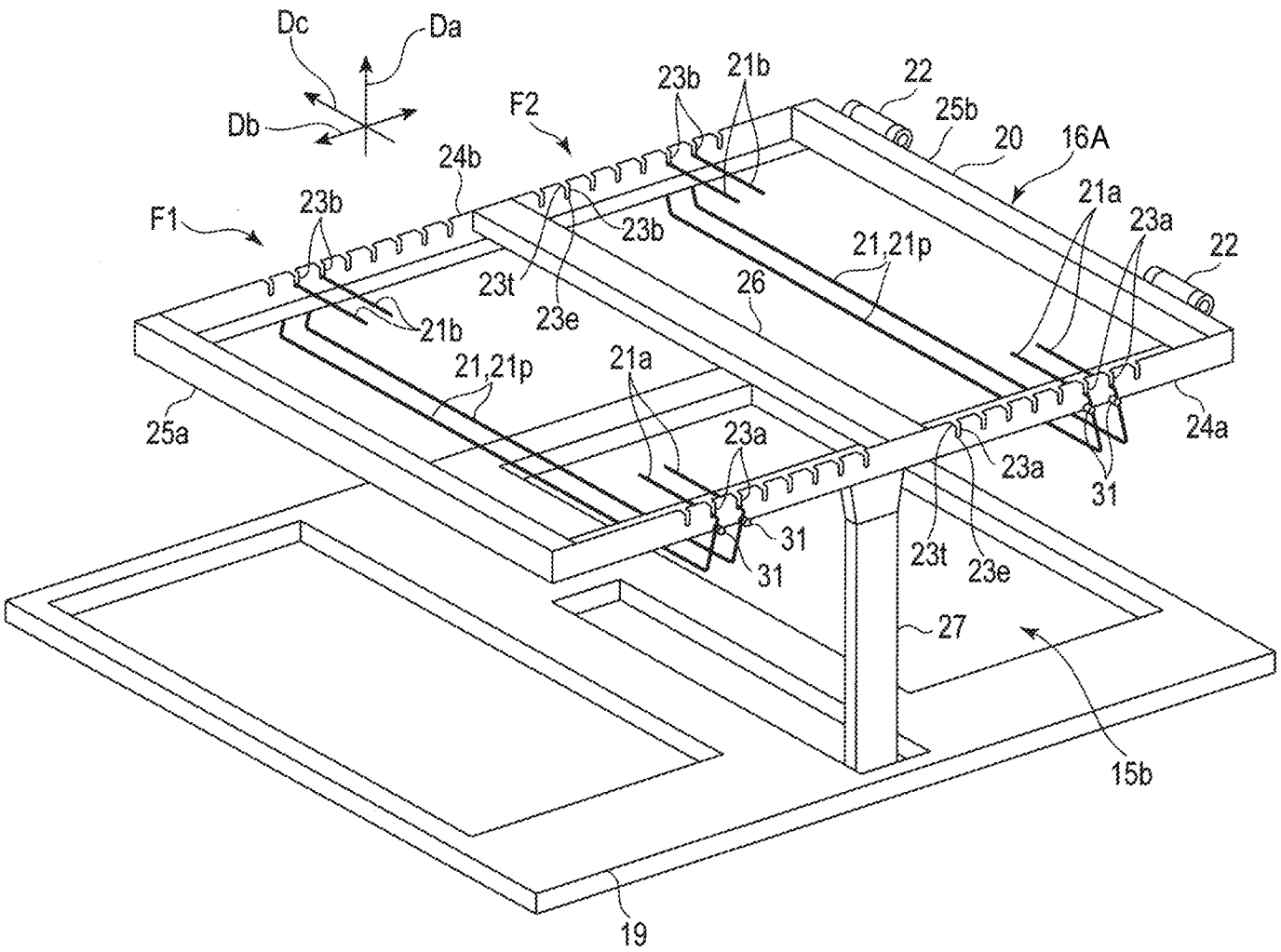
FIG. 7 is a perspective view illustrating a configuration of guides according to Variation 1 of this disclosure.
Figure 8:
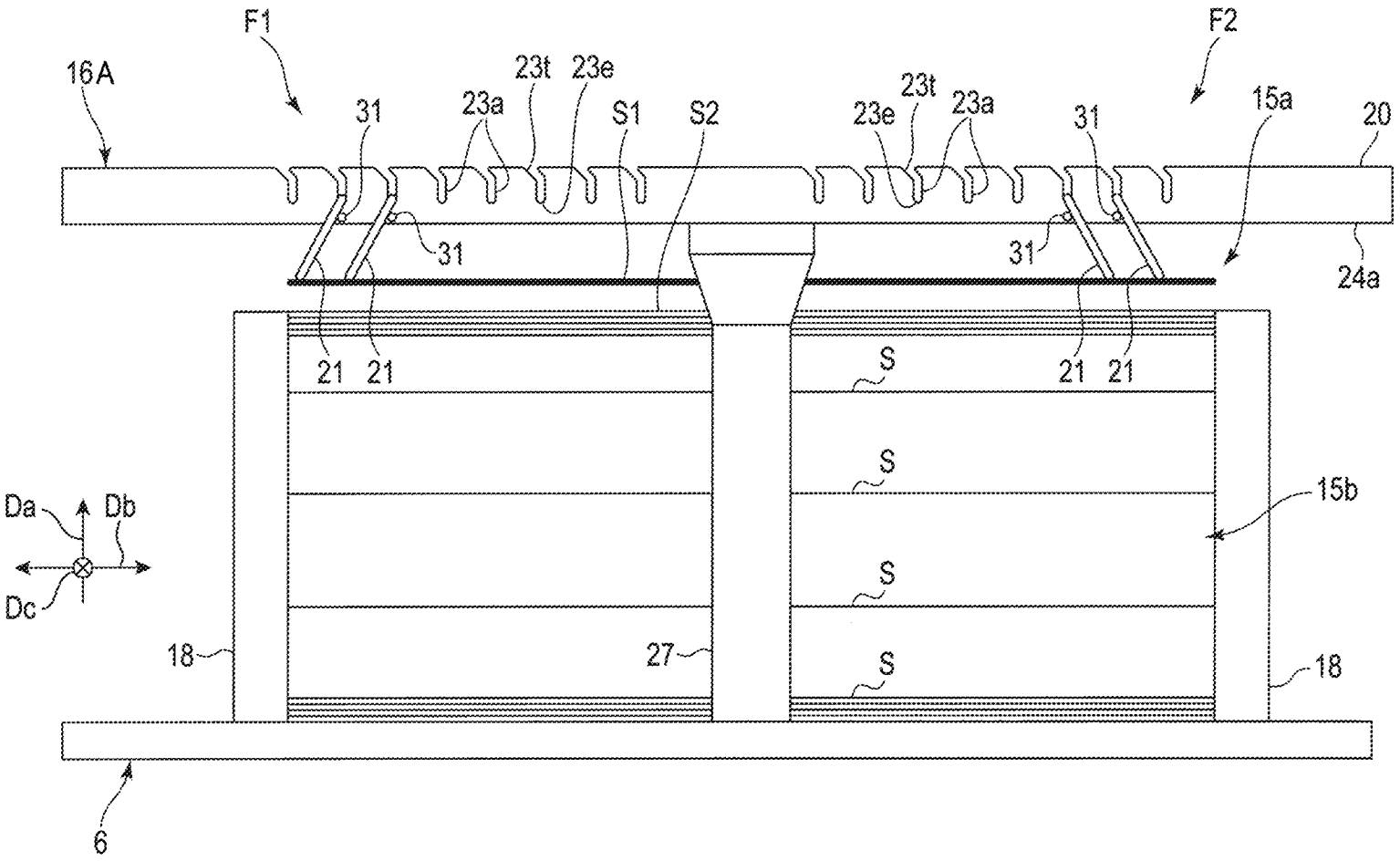
FIG. 8 is a rear side view illustrating a state in which lifting of a sheet is prevented by the guides of FIG. 7.

FIG. 7 is a perspective view illustrating a configuration of a guide mechanism 16A according to Variation 1 of this disclosure. FIG. 8 is a rear side view illustrating a state in which the guide mechanism 16A contained in the housing 1*p*, viewed from the end fence 27.

As illustrated in FIGS. 7 and 8, the guide mechanism 16A includes the frame 20 with regulation members 31, each of which functions as a regulator. Each of the regulation members 31 is configured to regulate a direction of changing the position of each of the guides 21 (specifically, the rotational direction of each of the guides 21) to a previously set direction (in other words, a previously set direction).

The regulation members 31 are disposed at the first supports 24*a* and the second supports 24*b* described in the above-described embodiment. Each of the regulation members 31 is disposed at a position lower than the lower end 23*e* of the first receiving portions 23*a* and the second receiving portions 23*b*, projecting from the first receiving portions 23*a* of the first supports 24*a* and the second receiving portions 23*b* of the second supports 24*b*. In this case, the protruding direction is set in a direction along the sheet conveyance direction Dc. Further, as a protruding shape of the regulation members 31, for example, a three-dimensional shape such as a cylindrical shape or a rectangular shape is assumed. Here, as an example, a cylindrical regulation member is employed as the regulation members 31. The diameter of each of the regulation members 31 may be the same as or different from a recess width in the first receiving portions 23*a* and the second receiving portions 23*b*.

In the example illustrated in FIGS. 7 and 8, the guides 21 are tilted to a posture in which the sheet contact portion 21*p* approaches the first connecting portion 25*a* on the first side F1 of the reinforcement member 26. On the other hand, the guides 21 are tilted to a posture in which the sheet contact portion 21*p* approaches the second connecting portion 25*b* on the second side F2 of the reinforcement member 26. In this case, on both sides, which are the first side F1 and the second side F2, of the reinforcement member 26, the inclination direction (the inclination angle) of the guides 21 may be set to be outwardly opposite to each other, or the inclination direction (the inclination angle) of the guides 21 may be inwardly opposite to each other. Further, the inclination direction (the inclination angle) of all the guides 21 supported by the frame 20 may be set to the identical direction to each other.

As described above, according to Variation 1, the respective postures of the guides 21 supported by the frame 20 are restricted to a previously set inclination direction (the previously set inclination angle). In this case, when the sheet S1 functioning as a conveyance target is separated from the other sheet S2, the guides 21 rotate in the given direction (i.e., the previously set direction) while contacting the sheet S1. Accordingly, this configuration achieves the constant contact state between the guides 21 (the sheet contact portion 21*p*) and the sheet S1 functioning as a conveyance target. As a result, when separating the sheet S1 functioning as a conveyance target from the other sheets S2 (e.g., the subsequent sheets S2), air passes easily between the sheet S1 and the other sheets S2.

Figure 9:
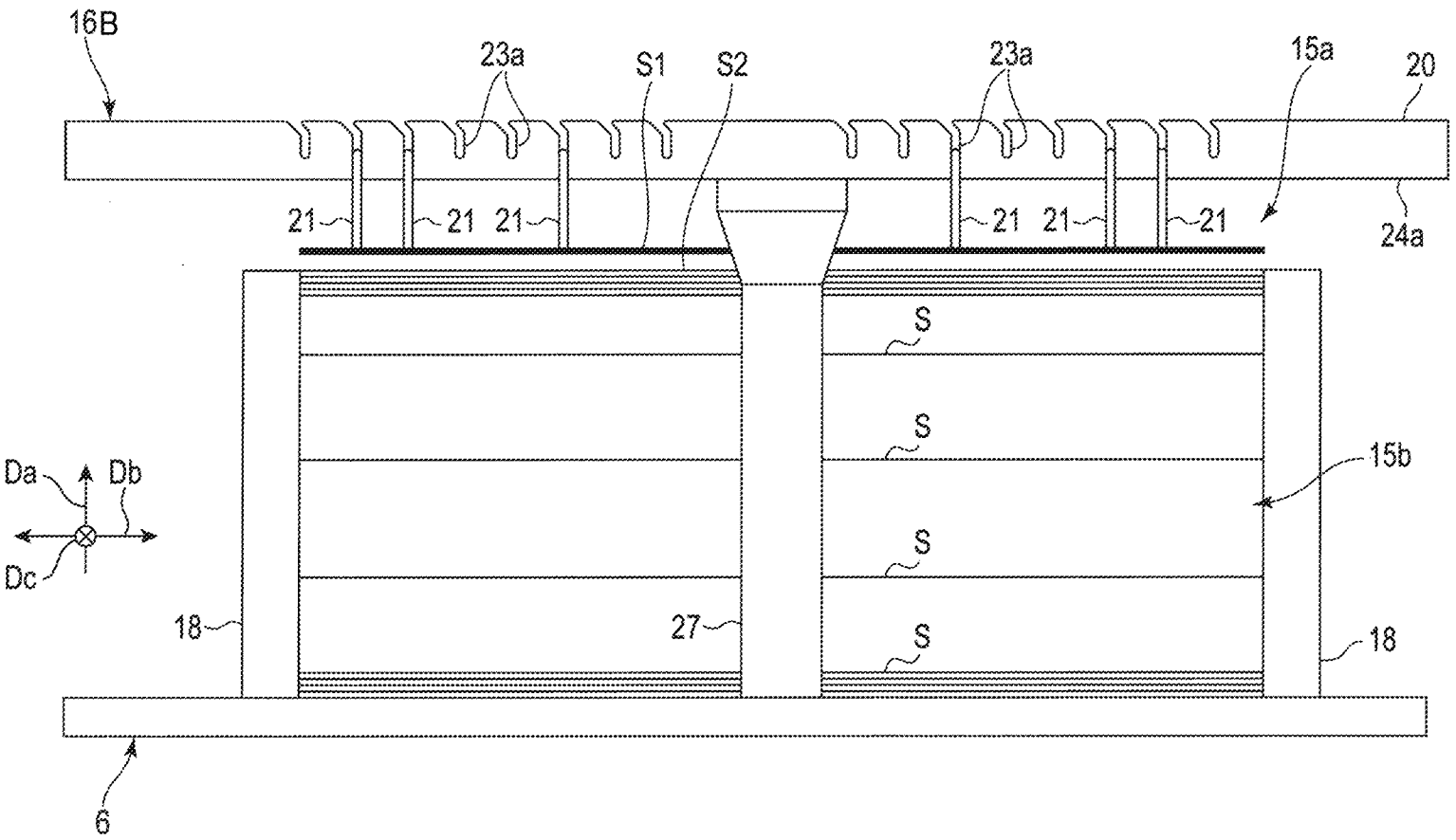
FIG. 9 is a rear side view illustrating a configuration of guides according to Variation 2 of this disclosure.

FIG. 9 is a rear side view illustrating the configuration of a guide mechanism 16B according to Variation 2 of this disclosure.

As illustrated in FIG. 9, in the guide mechanism 16A of Variation 2, each of the guides 21 is configured to be supported by any of the plurality of receiving portions, i.e., the first receiving portions 23*a* and the second receiving portions 23*b*. In this case, the contact position in the width direction of the guides 21 with respect to the sheet S1 functioning as a conveyance target is changed.

In the exemplary configuration illustrated in FIG. 9, two guides 21 each are supported at symmetrical positions of both sides (i.e., the first side F1 and the second side F2) of the reinforcement member 26, viewed in the width direction Db. In this case, the two inner guides 21 are arranged closer to the reinforcement member 26 than the other four guides 21.

As described above, according to Variation 2, each of the guides 21 is supported by any of the plurality of receiving portions, i.e., the first receiving portions 23*a* and the second receiving portions 23*b*. Accordingly, the effect of restraint to lifting of the sheet S1 functioning as a conveyance target is performed at the maximum with the minimum number of guides 21. As a result, the sheet S is conveyed without causing a jam.

Figure 10:
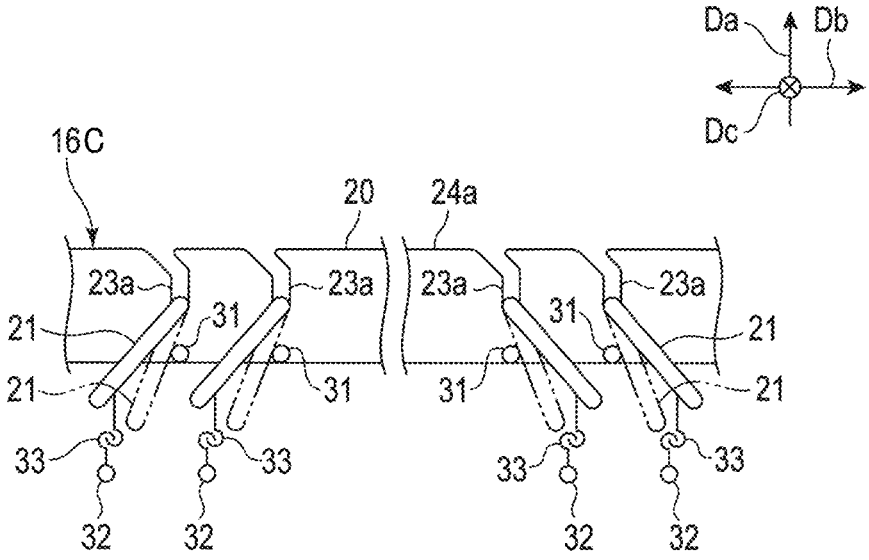
FIG. 10 is a front view illustrating a configuration of guides with an enlarged part, according to Variation 3 of this disclosure.

FIG. 10 is a front side view illustrating the configuration of a guide mechanism 16C according to Variation 3 of this disclosure, viewed from the first support 24*a*.

As illustrated in FIG. 10, in the guide mechanism 16C of Variation 3, each of the guides 21 is configured to change the weight according to various types of the plurality of sheets S to be contained in the sheet containing portion 15*b*. In this case, as a method of changing the weight of the guide 21, for example, a first method in which the guide 21 is changed or a second method in which another weight is added to the guide 21.

Here, in the first method, for example, the guide 21 (for example, the sheet contact portion 21*p*) is increased in size or in diameter to increase the weight of the guide 21 or the guide 21 (for example, the sheet contact portion 21*p*) is decreased in size or in diameter to reduce the weight of the guide 21. In FIG. 10, the configuration employing the second method is illustrated as an example.

In the second method, the weight 32 is attached to the guide 21. The weight 32 is attached to the guide 21 via an attachment 33. Here, it is preferable that various types of weights 32 with different weights are prepared according to the purpose of use and application. Further, it is preferable that the attachment 33 detachably attaches the weight 32 to the guide 21.

As described above, according to Variation 3, the weight of each of the guides 21 is changeable. Accordingly, the sheet S1 functioning as various types of conveyance targets from a lightweight, thin sheet S1 to a heavyweight, thick sheet S1 is stably conveyed.

Further, in the configuration of the above-described embodiment, the sheet feeding unit 6 is removed, together with the frame 20, from the sheet conveying device 1. However, the configuration of the sheet conveying device 1 is not limited to this configuration. For example, the following configuration of Variation 4 may be applied. In other words, in Variation 4, when the sheet feeding unit 6 is pulled out (removed) from the housing 1*p* of the sheet conveying device 1, the frame 20 remains in the housing 1*p* while supporting the guides 21.

As described above, according to Variation 4, the sheet feeding unit 6 does not include the frame 20 supporting the guides 21. In this case, the upper side of the sheet set opening 15*a* (the sheet containing portion 15*b*) is exposed. Accordingly, the plurality of sheets S is inserted to the sheet containing portion 15*b* through the sheet set opening 15*a* without rotating the frame 20. As a result, the setting efficiency of the sheet S with respect to the sheet containing portion 15*b* is enhanced.

Figure 11:
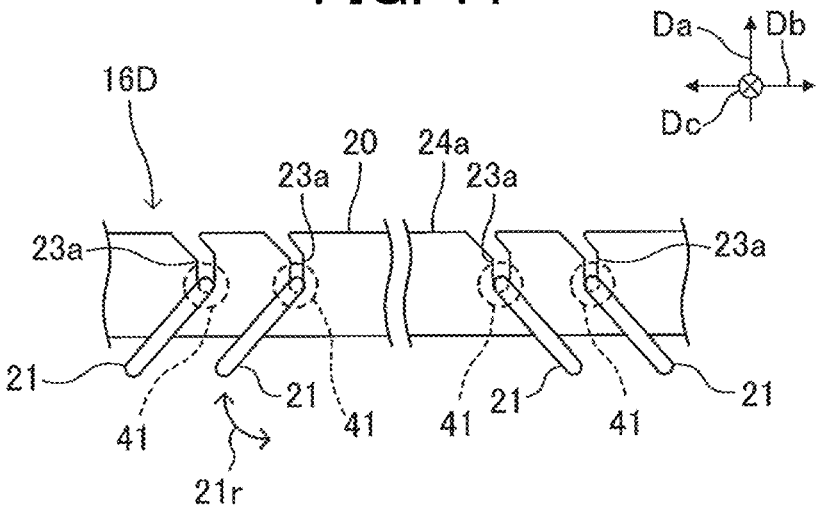
FIG. 11 is a side view illustrating a configuration of a guide mechanism according to Variation 5 of this disclosure, viewed from a first support.

FIG. 11 is a side view illustrating a configuration of a guide mechanism 16D according to Variation 5 of this disclosure, viewed from the first support 24*a*.

As illustrated in FIG. 11, the guides 21 of the guide mechanism 16D according to Variation 5 is supported by a bearing 41 that is fixed to the frame 20. The guide mechanism 16D further includes another structure on the second support 24*b* side. The structure on the second support is substantially identical to the structure on the first support 24*a* side. The bearing 41 has a shaft about which the guides 21 of the guide mechanism 16D rotates to perform the rotational motion 21*r*. In other words, each of the guides 21 is rotatable about a shaft of the bearing 41.

On the other hand, since the bearing 41 is fixed to the frame 20, the guides 21 do not move reciprocally in the vertical direction. Except the above-described structure, the configuration of the guide mechanism 16D according to Variation 5 is substantially identical to the guide mechanism 16 according to the present embodiment illustrated in FIG. 3.

As described above, in the guide mechanism 16D according to Variation 5, the sheet S1 that functions as a conveyance target is separated from the subsequent sheet S2 by an optimal distance and is supported at a position from which the sheet S1 is easily conveyed. Simultaneously, the sheet S1 is positioned parallel to the sheet conveyance direction Dc. As a result, the sheet S1 separated by air is significantly enhanced in the conveyance accuracy and conveyance stability.

Figure 12:
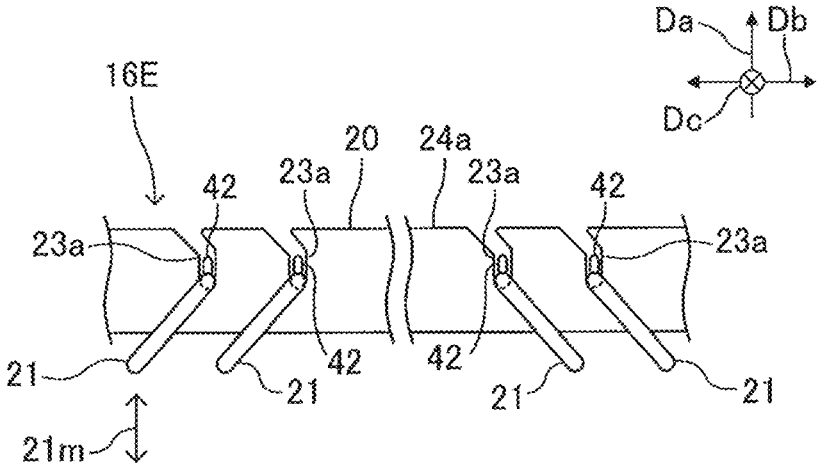
FIG. 12 is a side view illustrating a configuration of a guide mechanism according to Variation 6 of this disclosure, viewed from the first support.

FIG. 12 is a side view illustrating a configuration of a guide mechanism 16E according to Variation 6 of this disclosure, viewed from the first support 24*a*.

As illustrated in FIG. 12, the guides 21 of the guide mechanism 16E according to Variation 6 is attached to a slider 42 that extends vertically. The slider 42 is supported by the first receiving portions 23*a* to be movable in the vertical direction. The guide mechanism 16E further includes another structure on the second support 24*b* side. The structure on the second support is substantially identical to the structure on the first support 24*a* side. The guides 21 performs the reciprocating motion 21*m*, together with the slider 42, in the vertical direction.

On the other hand, since the slider 42 has a long shape extending along the first receiving portions 23*a*, the guides 21 do not perform the rotational motion 21*r*. Except the above-described structure, the configuration of the guide mechanism 16E according to Variation 6 is substantially identical to the guide mechanism 16 according to the present embodiment illustrated in FIG. 3.

Similarly, as described above, in the guide mechanism 16E according to Variation 6, the sheet S1 that functions as a conveyance target is separated from the subsequent sheet S2 by an optimal distance and is supported at a position from which the sheet S1 is easily conveyed. Simultaneously, the sheet S1 is positioned parallel to the sheet conveyance direction Dc. As a result, the sheet S1 separated by air is significantly enhanced in the conveyance accuracy and conveyance stability.

The sheet conveying device 1 having a configuration of any one of the present embodiment and Variations 1 to 5 includes the sheet containing portion 15*b*, the air blowing device 28, the guides 21, and a support such as the frame 20. The sheet containing portion 15*b* contains the plurality of sheets including the single sheet S1 and the subsequent sheets S2. The air blowing device 28 blows air to the plurality of sheets to separate the single sheet S1 from the subsequent sheets S2. The guides 21 contacts the surface of the single sheet S1 separated from the subsequent sheets S2 to guide the single sheet S1. The support such as the frame 20 supports both ends of each of the guides 21 in the sheet conveyance direction Dc of the single sheet S1. Both ends of each of the guides 21 are movable with respect to the frame 20 by the reciprocating motion 21*m* in the direction of thickness of the single sheet S1 or by the rotational motion 21*r* about the virtual axis 21*f* that extends along the sheet conveyance direction Dc. When compared with a configuration in which either end of each of the guides 21 in the sheet conveyance direction Dc is rotatable or vertically movable to the frame 20, the guides 21 of the guide mechanisms 16, 16A, 16B, 16C, 16D, and 16E according to any one of the present embodiment and Variations 1 to 5 guide the single sheet S1 while the attitude of the sheet S1 is remained parallel along the sheet conveyance direction Dc. As a result, the sheet S1 separated by air is significantly enhanced in the conveyance accuracy and conveyance stability.

The effects described in the embodiments of this disclosure are listed as most preferable effects derived from this disclosure, and therefore are not intended to limit to the embodiments of this disclosure.

The embodiments described above are presented as an example to implement this disclosure. The embodiments described above are not intended to limit the scope of the invention. These novel embodiments can be implemented in various other forms, and various omissions, replacements, or changes can be made without departing from the gist of the invention. These embodiments and their variations are included in the scope and gist of the invention, and are included in the scope of the invention recited in the claims and its equivalent.

What is claimed is:

1. A sheet conveying device comprising:

a sheet container configured to store a plurality of sheets;

an air blower configured to blow air to the plurality of sheets to separate a single sheet from subsequent sheets of the plurality of sheets; and a guide mechanism configured to contact a surface of the single sheet to resist rising and to guide the single sheet, separated from the subsequent sheets of the plurality of sheets, in a sheet conveyance direction, the guide mechanism including a plurality of receiving portions disposed along a direction of the single sheet, and a plurality of guides, each of the plurality of guides being suspended in the plurality of receiving portions, and being configured to contact the surface of the single sheet, wherein the plurality of guides are hooks, each respectively configured to be attachably detachable in respective ones of the plurality of receiving portions.

2. The sheet conveying device of claim 1, wherein the guide mechanism is configured to change a position of the plurality of guides while contacting the single sheet separated from subsequent sheets of the plurality of sheets.

3. The sheet conveying device of claim 2, wherein the guide mechanism has a virtual axis extending along the sheet conveyance direction, and wherein the guide mechanism is configured to rotate about the virtual axis while contacting the single sheet separated from the subsequent sheets of the plurality of sheets.

4. The sheet conveying device of claim 2, wherein the guide mechanism is configured to reciprocate in a direction of thickness of the single sheet separated from the subsequent sheets of the plurality of sheets while contacting the single sheet.

5. The sheet conveying device of claim 2, further comprising:

a frame configured to support the guide mechanism, wherein the frame includes a regulator configured to regulate a direction of changing the position of the guide mechanism to a given direction, and wherein the guide mechanism is configured to change the position of the guide while contacting the single sheet separated from the subsequent sheets of the plurality of sheets.

6. The sheet conveying device of claim 5, wherein the guide mechanism is supported by any of the plurality of receiving portions to change a contact position of the guide to the single sheet in a width direction.

7. The sheet conveying device of claim 1, further comprising:

a housing; and a sheet feeder contained in the housing, together with a frame supporting the guide mechanism, wherein the frame is configured to open and close the sheet container, and wherein the sheet feeder and the frame are configured to be removable together from the housing, while the frame is supporting the guide mechanism.

8. The sheet conveying device of claim 1, further comprising:

a housing; and a sheet feeder contained in the housing, together with a frame supporting the guide mechanism, wherein the frame is configured to open and close the sheet container, and wherein the sheet feeder is configured to be removable from the housing, in a state in which the frame supporting the guide mechanism remains in the housing.

9. The sheet conveying device according to claim 1, wherein the guide mechanism is configured to contact the surface of the single sheet separated from subsequent sheets, over at least a region from any position of the upstream region to a center of the single sheet in the sheet conveyance direction.

10. The sheet conveying device of claim 1, wherein the guide mechanism is disposed parallel to a surface of the plurality of sheets stored in the sheet container and parallel to the sheet conveyance direction.

11. An image forming system comprising:

the sheet conveying device of claim 1; and an image forming apparatus configured to form an image on a sheet of the plurality of sheets from the sheet conveying device.

12. The sheet conveying device of claim 1, wherein the plurality of guides are configured to be respectively detachably attachable in respective ones of the plurality of receiving portions.

13. The sheet conveying device of claim 1, wherein the plurality of guides are each of a same shape and size.

14. The sheet conveying device of claim 1, wherein a length of each of the plurality of guides is set in correspondence with the plurality of sheets.

* * * * *